United States Patent [19]

Brown et al.

[11] Patent Number: 4,904,400

[45] Date of Patent: Feb. 27, 1990

[54] METHOD OF IMPROVING THE SHEAR STABILITY OF LITHIUM SOAP GREASES

[75] Inventors: Terrance O. Brown, Corunna; David A. Slack; A. G. Alexander, both of Sarnia, all of Canada

[73] Assignee: Exxon Research and Engineering Company, Florham Park, N.J.

[21] Appl. No.: 287,933

[22] Filed: Dec. 21, 1988

Related U.S. Application Data

[63] Continuation of Ser. No. 80,454, Jul. 31, 1987, Pat. No. 4,822,503.

[51] Int. Cl.[4] ..... C10M 105/14

[52] U.S. Cl. ..... 252/32.7 E; 252/35

[58] Field of Search ..... 252/327 E, 35

[56] References Cited

U.S. PATENT DOCUMENTS

| | | | |
|---|---|---|---|
| 2,899,388 | 8/1959 | Nelson | 252/32.7 E |
| 2,932,614 | 1/1958 | Lynch | 252/32.7 E |
| 3,203,897 | 8/1965 | Ambrose | 252/32.7 E |
| 4,085,053 | 4/1978 | Caspari | 252/32.7 E |
| 4,536,308 | 8/1985 | Pehler | 252/32.7 E |

*Primary Examiner*—William R. Dixon, Jr.
*Assistant Examiner*—James M. Hunter, Jr.
*Attorney, Agent, or Firm*—John W. Ditsler

[57] ABSTRACT

A method for improving the shear stability of a multipurpose grease containing (i) a lubricating oil, (ii) a lithium soap of an hydroxy fatty acid, (iii) a polyhydric alcohol having at least three hydroxy groups, and (iv) at least two metal hydrocarbylthiophosphate compounds in which the metal is different in at least two compounds, is disclosed which comprises incorporating at least a major portion of the polyhydric alcohol into the mixture of lubricating oil and lithium soap of an hydroxy fatty acid and before the metal hydrocarbylthiophosphate compounds are added during the grease preparation process. Preferred ingredients are 12-hydroxystearic acid, glycerol, antimony dialkyldithiophosphate, and zinc dialkyldithiophosphate.

27 Claims, No Drawings

METHOD OF IMPROVING THE SHEAR STABILITY OF LITHIUM SOAP GREASES

CROSS-REFERENCE TO RELATED APPLICATIONS

This application is a continuation-in-part of U.S. Pat. application Ser. No. 080,454 filed Jul. 31, 1987, now U.S. Pat. No. 4,822,503.

BACKGROUND OF THE INVENTION

1. Field of the Invention

This invention concerns the preparation of high load-carrying lithium soap greases having improved shear stability.

2. Description of Related Art

Various methods have been suggested for preparing lithium soap greases (see, for example, C. J. Boner, Manufacture and Application of Lubricating Greases, Reinhold Publishing Corp., New York (1954); NLGI Lubricating Grease Guide, Second Edition, Published by NLGI, Kansas City, Mo. (1987); as well as U.S. Pat. Nos. 2,898,296; 2,940,930; and 3,791,973; the disclosures of which are incorporated herein by reference). In all of these methods, conventional additives (e.g. anticorrosive agents, pour point depressants, dyes, and the like) are usually added to the grease in the final steps of its preparation to form a fully formulated grease.

More recently, copending patent application U.S. Ser. No. 080,454 filed Jul. 31, 1987, now U.S. Pat. No. 4,822,505, discloses that the load-carrying capability of greases containing a lubricating oil and a thickener can be significantly enhanced by incorporating therein a polyhydric alcohol having at least three hydroxy groups and at least two metal hydrocarbylthiophosphate compounds in which the metal is different in at least two compounds. The alcohol and the phosphate compounds are added to the grease during the final steps of its preparation.

However, none of these disclosures suggest that the shear stability of the high load-carrying lithium soap greases described in U.S. Pat. No. 4,822,505 can be improved by modifying the point at which the polyhydric alcohol is added during preparation of the grease.

SUMMARY OF THE INVENTION

This invention concerns a method of preparing high load-carrying lithium soap greases (specifically, simple lithium and lithium complex soap greases) having enhanced shear stability by modifying the usual procedure for preparing these greases.

Briefly, lithium soap greases are conventionally prepared by first forming a mixture of a lubricating oil and a lithium soap of an hydroxy fatty acid. If a lithium complex soap grease is to be prepared, a dicarboxylic acid would normally be added at this point and neutralized with a lithium base. The temperature of the resulting mixture is then increased to between about 350° and about 400° F. (i.e., the so-called "cookout"). Thereafter, the mixture is cooled to a temperature between about 150° and about 200° F., at which time any additives may be incorporated into the mixture to form a fully-formulated grease.

However, we have discovered that the shear stability of a grease comprising (i) a lubricating oil, (ii) a lithium soap of an hydroxy fatty acid, (iii) a polyhydric alcohol having at least three hydroxy groups, and (iv) at least two metal hydrocarbylthiophosphate compounds in which the metal is different in at least two compounds will be enhanced if conventional preparation procedures are modified by adding at least a major portion of the polyhydric alcohol to the mixture of lubricating oil and lithium soap of an hydroxy fatty acid before the high temperature "cookout"—i.e., the alcohol is added after the lithium soap has been dispersed in the lubricating oil but before "cookout", while the phosphate compounds (and other additives) are added after "cookout". For a lithium complex soap grease, the polyhydric alcohol is also added before "cookout"; i.e., the alcohol is added after the lithium soap of an hydroxy fatty acid has been dispersed in the lubricating oil, after neutralization of the dicarboxylic acid, or both. Preferred ingredients are 12-hydroxystearic acid, azelaic acid, glycerol, antimony dialkyldithiophosphate, and zinc dialkyldithiophosphate.

DETAILED DESCRIPTION OF THE INVENTION

A wide variety of lubricating oils can be used to prepare the high load-carrying, shear stable greases of this invention. For example, the lubricating oil base can be any of the conventionally used mineral oils, synthetic hydrocarbon oils or synthetic ester oils, depending upon the particular grease being prepared. In general these lubricating oils will have a viscosity in the range of about 5 to about 10,000 cSt at 40° C., although typical applications will require an oil having a viscosity ranging from about 10 to about 1,000 cSt at 40° C. Mineral lubricating oil base stocks used in preparing the greases can be any conventionally refined base stocks derived from paraffinic, naphthenic, and mixed base crudes. Synthetic lubricating oils that can be used include esters of dibasic acids, such as di-2-ethylhexyl sebacate, esters of glycols such as a $C_{13}$ oxo acid diester of tetraethylene glycol, or complex esters such as one formed from 1 mole of sebacic acid and 2 moles of tetraethylene glycol and 2 moles of 2-ethylhexanoic acid. Other synthetic oils that can be used include synthetic hydrocarbons such as polyalphaolefins; alkyl benzenes, e.g. alkylate bottoms from the alkylation of benzene with tetrapropylene, or the copolymers of ethylene and propylene; silicon oils, g. ethyl phenyl polysiloxanes, methyl polysiloxanes, etc.; polyglycol oils, e.g. those obtained by condensing butyl alcohol with propylene oxide; carbonate esters, e.g. the product of reacting $C_8$ oxo alcohol with ethyl carbonate to form a half ester followed by reaction of the latter with tetraethylene glycol, etc. Other suitable synthetic oils include the polyphenyl ethers, e.g. those having from about 3 to 7 ether linkages and about 4 to 8 phenyl groups. (See U.S. Pat. No. 3,424,678, column 3.) The amount of lubricating oil in the grease can also vary broadly, but, typically, will range from about 50 to about 98 wt. %, preferably from about 75 to about 95 wt. %, of the grease.

The grease will also contain a lithium soap of an hydroxy fatty acid. The hydroxy fatty acid employed will have from about 12 to 24, or more usually about 16 to 20, carbon atoms and will preferably be a hydroxy stearic acid, e.g., 9-hydroxy, 10-hydroxy, or 12-hydroxystearic acid, more preferably the latter. Ricinoleic acid, which is an unsaturated form for 12-hydroxy stearic acid (having a double bond in the 9-10 position), can also be used. Other hydroxy fatty acids include 12-hydroxy behenic acid and 10-hydroxy palmitic acid.

The lithium soap used in this invention includes not only a simple lithium soap prepared from the hydroxy fatty acid described above, but also a lithium complex soap prepared from the hydroxy fatty acid and a dicarboxylic acid as described in U.S. Pat. No. 3,791,973. The particular dicarboxylic acid used will have from 2 to 12, preferably from 4 to 12 and most preferably from 6 to 10, carbon atoms. Suitable dicarboxylic acids include oxalic, malonic, succinic, glutaric, adipic, suberic, pimelic, azelaic, dodecanedioic, and sebacic acids. Sebacic acid and azelaic acid are particularly preferred. The proportion of dicarboxylic acid to hydroxy fatty acid in the lithium complex grease should range from about 0.2 to about 1.0, preferably from about 0.5 to about 0.8, moles of dicarboxylic acid per mole of hydroxy fatty acid.

The total soap content of the shear stable grease of this invention should be sufficient to thicken the grease to the desired consistency. Normally, the total soap content will range from about 1 to about 30 wt. % of the grease. For most purposes, the total soap content should be between about 5 to about 20 wt. %, preferably between about 10 to about 15 wt. %, of the grease.

The polyhydric alcohol used herein can be any of the aliphatic polyhydric alcohols having at least 3 hydroxy groups. Alcohols containing 3 or 4 hydroxy groups are preferred. Specific examples of alcohols which may be used include glycerol, pentaerythritol, and the like. Alcohols containing 3 hydroxy groups are more preferred, glycerol being particularly preferred.

The metal hydrocarbylthiophosphate compounds used in preparing the greases of this invention may be represented by the formula:

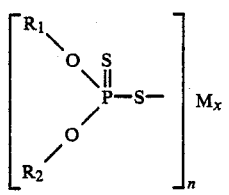

wherein n is 1–6, preferably 2–4 and more preferably 2–3; and x is 1–3, preferably 1–2, and preferably 1. $R_1$ and $R_2$ may each individually be hydrogen or a hydrocarbyl group of from 1 to 30, preferably from 1 to 20, and more preferably from 1 to 10, carbon atoms. More particularly, the hydrocarbyl group may be an alkyl, aryl, alkaryl, or aralkyl group, and the unsaturated counterparts thereof, or mixtures thereof. The groups as defined for $R_1$ and $R_2$ may include heterooxygen, nitrogen, sulfur, or phosphorus atoms interspersed therein. Preferred hydrocarbylthiophosphate compounds are the alkylthiophosphates, with dialkyldithiophosphates being most preferred.

M can be any metal selected from the group of aluminum, antimony, cadmium, copper, lead, tin, and zinc. Preferred metals are antimony, lead, and zinc, with antimony and zinc being most preferred. Thus, preferred metal hydrocarbylthiophosphates include antimony dialkyldithiophosphates, lead dialkyldithiophosphates, and zinc dialkyldithiophosphates. Accordingly, preferred metal hydrocarbylthiophosphate groups include antimony dialkyldithiophosphates in combination with lead dialkyldithiophosphates, zinc dialkyldithiophosphates or their mixtures, with antimony dialkyldithiophosphates and zinc dialkyldithiophosphates being most preferred.

Although very minor amounts of the polyhydric alcohol and the metal hydrocarbylthiophosphate compounds can be used, these additives will normally be employed within certain ranges. In the case of the polyhydric alcohol, from about 0.1 to about 5 wt. %, preferably from about 0.2 to 1.0 wt. %, based on weight of the grease, will be employed. The total amount of metal hydrocarbylthiophosphate compounds used will range from about 0.2 to about 10 wt. %, based on weight of the grease. Methods of preparing the polyhydric alcohol and metal hydrocarbylthiophosphate compounds used herein are well known to one skilled in the art.

To prepare the high load-carrying and shear stable greases of this invention, the lithium soap of an hydroxy fatty acid could be preformed and then dispersed in the lubricating oil for both the simple lithium and lithium complex soaps. (In contrast, the dicarboxylic acid cannot be preformed for the lithium complex soap.) However, it is generally more expedient to prepare the lithium soap in situ in the lubricating oil by neutralizing the hydroxy fatty acid with lithium base, which generally will be lithium hydroxide.

When the lithium soap of an hydroxy fatty acid is prepared in situ in the usual procedure is to charge into the grease kettle from about one-fourth to about one-half of the total amount of lubricating oil base that will be finally incorporated into the final grease and to then add the hydroxy fatty acid. The mixture of fatty acid and oil is heated sufficiently to dissolve the acid into the oil, e.g., at a temperature between about 150° to about 220° F., preferably between about 180° to about 200° F. Normally, the fatty acid will be dissolved in the oil fairly rapidly such that dissolution can be nearly completed in from about 0.5 to about 1 hour, although times outside this range could be used. Then a concentrated aqueous solution of lithium hydroxide is added, usually in an amount slightly in excess of the stoichiometric amount required to neutralize the acid, the temperature at this stage usually being between about 150° to about 220° F., preferably between about 200° to about 210° F. The rate of lithium hydroxide addition is not critical, although from 30 minutes to about 2 hours may be required depending on the facilities at the grease plant. (If a lithium complex rather than a simple lithium soap were to be prepared, the dicarboxylic acid could be added and subsequently neutralized to its dilithium soap at this point, but this would require neutralizing the acid very slowly or stepwise to ensure complexing of the two types of soaps with each other before complete neutralization of the dicarboxylic acid has occurred.)

Once neutralization of the hydroxy fatty acid is nearly complete, the temperature of the lubricating oil/lithium soap of an hydroxy fatty acid mixture is increased to between about 220° to about 350° F., preferably between about 250° to about 320° F., and more preferably between about 280° to about 300° F., for a period of time sufficient to complete the neutralization and to effect a substantial dehydration of the mixture, i.e., the removal of 70 to 100% of the water. (In the case of a lithium complex grease, substantial dehydration at this point also promotes the subsequent complexing reaction during neutralization of the dicarboxylic acid.) For a simple lithium soap, the next step is to continue increasing the temperature of the mixture until it is between about 350° to about 400° F., preferably between about 380° to about 400° F., as described hereinafter.

If, however, the lithium soap of an hydroxy fatty acid had been preformed, the next step following dispersion of the soap into the oil (typically at temperatures between about 150° and about 220° F.) would be to increase the temperature of the mixture to between about 350° and about 400° F. Dehydration is not required because water would not normally be present since aqueous lithium base is not needed with the preformed soap.

If a lithium complex soap instead of a simple lithium soap were to be prepared, the next step following dehydration would be to cool the lubricating oil/lithium soap of an hydroxy fatty acid mixture to a temperature between about 200° to about 260° F., preferably between about 220° and about 240° F., as rapidly as possible, the speed of cooling being primarily to save time. A dicarboxylic acid is then added to the lubricating oil/-hydroxy fatty acid mixture thus formed. This mixture is stirred for a short time (e.g. 30 minutes or less) to ensure proper dispersion throughout the mixture. A concentrated aqueous solution of lithium hydroxide is then added to convert the dicarboxylic acid to its dilithium soap. Normally, the amount of lithium hydroxide added is slightly in excess of the amount stoichiometrically required to neutralize both acid groups of the dicarboxylic acid. During the addition of the lithium hydroxide (which will ordinarily take from about 30 minutes to about 2 hours) the temperature will be maintained within the range of about 200° to about 240° F., preferably between about 210° to about 230° F. After all of the lithium hydroxide has been added and neutralization of the dicarboxylic acid is nearly complete, the temperature of the grease mixture is raised to between about 220° to about 350° F., preferably between about 250° to about 320° F., and more preferably between about 280° and about 300° F., for a period of time sufficient to complete the neutralization and to effect a substantial dehydration of the mixture as described above.

The critical aspect of this invention is the recognition that a simple lithium soap grease having improved shear stability will be obtained only if at least a major portion, preferably at least 75%, more preferably at least 90%, and most preferably essentially all of the polyhydric alcohol is added to the lubricating oil/ lithium soap of an hydroxy fatty acid mixture before the high temperature "cookout" discussed below, regardless of whether the lithium soap is preformed or obtained in situ by acid neutralization. For a lithium complex soap grease, the polyhydric alcohol must be added before the high temperature "cookout" as above, but the addition may be made after the lithium soap of an hydroxy fatty acid (whether preformed or obtained in situ) has been dispersed (or dissolved if in situ) in the lubricating oil, after the dicarboxylic acid has been neutralized, or both. The high load-carrying capability of this grease (as described in U.S. Pat. No. 4,822,505) will also be retained. Thus, the lithium soap greases of this invention will have both enhanced load-carrying capability and shear stability.

Following acid neutralization (neutralization of the hydroxy fatty acid for a simple lithium soap grease, and the hydroxy fatty acid and the dicarboxylic acid for a lithium complex soap grease) and alcohol addition, the temperature of the grease mixture is increased to between about 350° to about 400° F., preferably between about 380° to about 400° F., and maintained at that level for about 15 minutes to about 1 hour to ensure optimum soap crystallization and improved yields. This increase in temperature (or "cookout") is effected as rapidly as possible to save time and to minimize oxidation.

The soap stock is then cooled as rapidly as possible. This cooling is aided by incorporating the remaining quantity of lubricating oil into the mixture. Mixing can be continued until the grease reaches ambient temperatures. The grease may be passed through a conventional grease mill at this point to obtain a somewhat improved yield and appearance. Suitable grease mills include a Morehouse mill, a Charlotte mill, and a Gaulin homogenizer.

When the temperature has been lowered to between about 150° to about 200° F., preferably between about 150° to about 170° F., the metal hydrocarbylthiophosphate compounds and other grease additives, if any, that are desired in the grease can be introduced. Such additives include, but are not limited to, anticorrosive agents, pour point depressants, tackiness agents, viscosity improvers, oxidation inhibitors, dyes and the like, which are incorporated for specific purposes. The grease may also be passed through a grease mill again to obtain a further improvement in yield and appearance.

Although in most instances the lithium hydroxide used in forming the hydroxy fatty acid soap (and the dicarboxylic acid soap for a lithium complex grease) is most conveniently introduced into the grease kettle as a saturated aqueous solution, dry lithium hydroxide can also be used. Ordinarily, however, the average grease plant will not have proper facilities for convenient handling of dry lithium hydroxide.

Normally a slight excess of lithium hydroxide is used during the soap formation stage(s), i.e., above the stoichiometric amount theoretically required for complete neutralization of the acid(s). Typically, this excess will range from about 0.2 to 0.4 wt. % of free alkali expressed as sodium hydroxide (ASTM D128).

During the various steps in its preparation, the ingredients may be mixed or blended in any number of ways which can readily be selected by one skilled in the art. Suitable mixing means include angers, screw extruders, stirred kettles, Stratco contacters, and the like.

The multipurpose grease of this invention has a variety of uses and may be suitably employed in essentially any application requiring a high loadcarrying shear stable grease, including use in wheel bearing, industrial equipment, and the like.

This invention will be further understood by reference to the following Examples which are not intended to restrict the scope of the claims appended hereto.

EXAMPLE 1

Improved Shear Stability

Three samples of a lithium complex grease were prepared as follows:

Stage 1—12-hydroxystearic acid and lubricating oil were combined with mild heating (about 180° F.) until the acid was dissolved. When dissolution of the acid into the oil was nearly complete, an equivalent amount (plus slight excess) of lithium hydroxide dissolved in water was added while the temperature of the grease was maintained at between 200° and 210° F. Once the lithium had been added, the mixture was heated quickly to about 300° F. to evaporate the water and complete the neutralization. The grease was then cooled to about 220° F.

Stage 2—At about 220° F., the desired amount of azelaic acid was added and allowed to dissolve in the mixture. When solution was complete, an equivalent amount (plus slight excess) of lithium hydroxide dissolved in water was added over a 45 minute period while the temperature was maintained at about 210° to about 230° F. The alkalinity of the mixture was then checked by a standard titration to ascertain whether the reaction was complete. (If not complete, small make-up amounts of azelaic acid or lithium hydroxide may be added at this point if required.) Once acid addition was complete, the mixture was heated to about 300° F. to evaporate the water and complete the neutralization.

Stage 3—The grease mixture was heated to about 380° to about 400° F. and held for about 20 minutes. At this point, the grease was cooled by slow addition of the remaining portion of the lubricating oil. Once the mixture reaches about 160° to about 180° F., the product was removed from the lab kettle and passed through a colloid mill set at about 5 to 10 thousandths of an inch clearance.

Stage 4—The milled product was then returned to the kettle and maintained at about 150° F. with stirring. At this point, the additives are incorporated slowly and thoroughly mixed into the grease. Once this is completed, the product was milled a second time and the consistency determined by ASTM D217.

However, in Sample 1, glycerol was added to the grease at Stage 4; in Sample 2, glycerol was added at Stage 1, and in Sample 3, glycerol was added at Stage 2.

The shear stability of each sample was then determined by the procedure described in ASTM D217, the disclosure of which is incorporated herein by reference. First, the consistency of the grease was measured using a grease pentrometer after working the grease sixty double strokes in a standard grease worker. Next, the grease was worked at room temperature for an additional 100,000 double strokes. When the extended working was completed, the grease was allowed to cool to room temperature and the consistency again determined as per ASTM D217 (i.e., after an additional sixty double strokes). The difference in the two measurements is the shear stability of the product. The results of these tests are shown in Table 1 below:

TABLE 1

| | | Shear Stability (1) | | | | | |
|---|---|---|---|---|---|---|---|
| | | Base Grease (2) | | | | | Final Product (3) |
| Sample No. | Glycerol Added | X60 | X 100, 000 | Delta | X60 | X 100, 000 | Delta |
| 1 | Stage 4 | 273 | 304 | 31 | 274 | 339 | 65 |
| 2 | Stage 1 | 275 | 299 | 24 | 295 | 305 | 10 |
| 3 | Stage 2 | 268 | 290 | 22 | 295 | 303 | 8 |

(1) Expressed as mm/10 per ASTM D217. Shear stability given as Delta.
(2) No conventional grease additives added except that glycerol was added to Samples 2 and 3, but not to Sample 1.
(3) All samples include glycerol and the same conventional grease additives.

The data in Table show that the shear stability of a lithium based grease is enhanced when a polyhydric alcohol is added following neutralization of the hydroxy fatty acid or after neutralization of the dicarboxylic acid, but before the high temperature "cookout". As such, enhanced shear stability would also be expected to be obtained if a portion of the alcohol were after neutralization of the hydroxy fatty acid and a portion were added after neutralization of the dicarboxylic acid.

EXAMPLE 2

Retained High Load-Carrying Capability

The load-carrying capability of the final product for Samples 2 and 3 from Example 1 were determined using a Timken test machine. In the Timken test, a hardened steel ring or "cup" is rotated against a hardened steel test block while being lubricated with the grease under test. A test grease is deemed a "failure" if the test block is damaged during the test, and a "pass" if the test block is not damaged. Further details regarding the Timken test procedure may be found in ASTM D2782, the disclosure of which is incorporated herein by reference. The results of these tests are shown in Table 2 below:

TABLE 2

| Sample No. | Glycerol Added | Load-Carrying Final Product Pass, lbs |
|---|---|---|
| 1 | Stage 4 | (1) |
| 2 | Stage 1 | 60 |
| 3 | Stage 2 | 60 |

(1) Not measured, but Sample 1 will have a load-carrying capability comparable to that of Samples 2 and 3 because all samples contain the same ingredients responsible for high load-carrying capability (see U.S. Pat. No. 4,822,505).

The data in Table 2 show that a lithium based grease prepared according to this invention will have a load-carrying capability comparable to the same grease prepared by the conventional methods disclosed in U.S. Pat. No. 4,822,505.

What is claimed is:

1. In a method for preparing a grease containing
(i) a lubricating oil,
(ii) a lithium soap of an hydroxy fatty acid,
(iii) a polyhydric alcohol having at least three hydroxy groups, and
(iv) at least two metal hydrocarbylthiophosphate compounds in which the metal is different in at least two compounds, by the steps comprising
(a) forming a mixture of the lubricating oil and the lithium soap of an hydroxy fatty acid at a temperature between about 150° and about 220° F.,
(b) increasing the temperature of the product from step (a) to between about 350° and about 400° F. for a period of tie sufficient to improve crystallization of the lithium soap in the oil,
(c) cooling the product from step (b) to a temperature between about 150° and about 200° F., and
(d) adding the polyhydric alcohol and the metal hydrocarbylthiophosphate to the product from step (c), the improvement which comprises adding at least a major portion of the polyhydric alcohol to the mixture of lubricating oil and lithium soap of an hydroxy fatty acid before step (b) to increase the shear stability of the grease.

2. The method of claim 1 wherein the lithium soap in (a) is formed in the lubricating oil by contacting an hydroxy fatty acid with at least a stoichiometric amount of a lithium base.

3. The method of claim 2 wherein a dicarboxylic acid is added to the lithium soap thus formed and the mixture of dicarboxylic acid and lithium soap is then contacted with at least a stoichiometric amount of lithium base to convert the dicarboxylic acid to its dilithium soap.

4. The method of claim 1, 2, or 3 wherein the polyhydric alcohol is selected from the group consisting of glycerol, pentaerythritol, and mixtures thereof.

5. The method of claim 1, 2, or 3 wherein the metal hydrocarbylthiophosphate compounds have the formula:

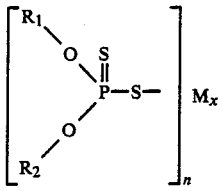

wherein n is 1–6; x is 1–3; $R_1$ and $R_2$ may each be hydrogen or a hydrocarbyl group having from 1 to 30 carbon atoms; and M is a metal selected from the group consisting of aluminum, antimony, cadmium, copper, lead, tin, zinc, and mixtures thereof in which the metal is different in at least two compounds.

6. The method of claim 5 wherein the hydrocarbyl group is saturated or unsaturated alkyl, aryl, alkaryl, aralkyl, or mixtures thereof.

7. The method of claim 5 wherein the metal hydrocarbylthiophosphate compounds are metal alkylthiophosphate compounds.

8. In a method for preparing a grease containing
(i) a lubricating oil,
(ii) a lithium soap of a $C_{12}$–$C_{24}$ hydroxy fatty acid,
(iii) a polyhydric alcohol selected from the group consisting of glycerol, pentaerythritol, and mixtures thereof, and
(iv) at least two metal hydrocarbylthiophosphate compounds having the formula:

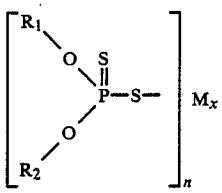

wherein n is 1–6; x is 1–3; $R_1$ and $R_2$ may each be hydrogen or a hydrocarbyl group having from 1 to 30 carbon atoms; and M is a metal selected from the group consisting of aluminum, antimony, cadmium, copper, lead, tin, zinc, and mixtures thereof; in which the metal is different in at least two compounds, by the steps comprising
(a) forming a mixture of the lubricating oil and the lithium soap of an hydroxy faty acid at a temperature between about 150° and about 220° F.,
(b) increasing the temperature of the product from step (a) to between about 350° and about 400° F. for a period of time sufficient to improve dispersion of the lithium soap in the oil,
(c) cooling the product from step (b) to a temperature between about 150° and about 200° F., and
(d) adding the polyhydric alcohol and the metal hydrocarbylthiophosphate to the product from step (c), the improvement which comprises adding at least a major portion of the polyhydric alcohol to the mixture of lubricating oil and lithium soap of a $C_{12}$–$C_{24}$ hydroxy fatty acid before step (b) to increase the shear stability of the grease.

9. The method of claim 8 wherein the lithium soap is formed in the lubricating oil by contacting a $C_{12}$–$C_{24}$ hydroxy fatty acid with at least a stoichiometric amount of lithium hydroxide.

10. The method of claim 9 wherein a $C_2$–$C_{12}$ dicarboxylic acid is added to the lithium soap thus formed and the mixture of dicarboxylic acid and lithium soap is then contacted with at least a stoichiometric amount of lithium hydroxide to convert the dicarboxylic acid to its dilithium soap.

11. The method of claim 8, 9, or 10 wherein the polyhydric alcohol comprises glycerol.

12. The method of claim 8, 9, or 10 wherein n is 2–4.

13. The method of claim 12 wherein n is 2–3.

14. The method of claim 8, 9, or 10 wherein x is 1–2.

15. The method of claim 14 wherein x is 1.

16. The method of claim 8, 9, or 10 wherein the metal hydrocarbylthiophosphate compounds comprise at least two metal alkylthiophosphate compounds.

17. The method of claim 16 wherein the metal is selected from the group consisting of antimony, lead, zinc, and mixtures thereof.

18. The method of claim 16 wherein the metal alkylthiophosphate compounds comprise two metal dialkyldithiophosphate compounds.

19. The method of claim 18 wherein the metal dialkyldithiophosphate compounds are antimony dialkyldithiophosphate and zinc dialkyldithiophosphate.

20. In a method for preparing a grease containing
(i) a lubricating oil,
(ii) a lithium soap of a $C_{12}$–$C_{24}$ hydroxy fatty acid,
(iii) a lithium soap of a $C_2$–$C_{12}$ dicarboxylic acid,
(iv) from about 0.1 to about 5 wt. % glycerol, and
(v) from about 0.2 to about 10 wt. % of at least two metal dialkyldithiophosphate compounds in which the metal is different in at least two compounds, by the steps comprising:
(a) forming a mixture of the lubricating oil and the lithium soap of a $C_{12}$–$C_{24}$ hydroxy fatty acid at a temperature between about 150° and about 220° F.,
(b) substantially dehydrating the product from step (a) at a temperature between about 220° and about 350° F.,
(c) cooling the product from step (b) to a temperature between about 200° and about 260° F.,
(d) adding a $C_2$–$C_{12}$ dicarboxylic acid to the product formed in step (c),
(e) contacting the mixture formed in step (d) with at least a stoichiometric amount of lithium hydroxide, the contacting occurring at a temperature between about 200° and about 240° F.,
(f) substantially dehydrating the product from step (e) at a temperature between about 220° and about 350° F.,
(g) increasing the temperature of the product from step (f) to between about 350° and about 400° F. for a period of time sufficient to improve dispersion of the lithium soap in the oil,
(h) cooling the product from step (g) to a temperature between about 150° and about 200° F., and
(i) adding the glycerol and the metal dialkyldithiophosphate compounds to the product from step (h), the improvement which comprises adding at least a major portion of the glycerol to the mixture formed in step (a), adding at least a major portion of the glycerol to the mixture formed in step (e), or adding at least a major portion of the glycerol to the mixtures formed in steps (a) and (e) to increase the shear stability of the grease.

21. The method of claim 20 wherein the lithium soap of a $C_{12}$–$C_{24}$ hydroxy fatty acid is formed in the lubricating oil by contacting a $C_{12}$–$C_{24}$ hydroxy fatty acid with at least a stoichiometric amount of lithium hydroxide.

22. The method of claim 21 wherein the hydroxy fatty acid comprises 12-hydroxystearic acid.

23. The method of claim 22 wherein the dicarboxylic acid comprises azelaic acid.

24. The method of claim 20, 21, or 23 wherein the total amount of glycerol added ranges from about 0.2 to about 1.0 wt. %.

25. The method of claim 24 wherein the amount of metal dialkyldithiophosphate compounds added ranges from about 0.5 to about 4 wt. %.

26. The method of claim 20, 21, or 23 wherein the metal is selected from the group consisting of antimony, lead, zinc, and mixtures thereof.

27. The method of claim 20, 21, or 23 wherein the metal dialkyldithiophosphate compounds are antimony dialkyldithiophosphate and zinc dialkyldithiophosphate.

* * * * *